US009519247B2

(12) United States Patent
Takagi et al.

(10) Patent No.: US 9,519,247 B2
(45) Date of Patent: Dec. 13, 2016

(54) FIXING DEVICE AND IMAGE FORMING APPARATUS INCLUDING THE SAME

(71) Applicant: KYOCERA Document Solutions Inc., Osaka (JP)

(72) Inventors: Masaru Takagi, Osaka (JP); Koji Izumi, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 15/044,483

(22) Filed: Feb. 16, 2016

(65) Prior Publication Data

US 2016/0246224 A1 Aug. 25, 2016

(30) Foreign Application Priority Data

Feb. 23, 2015 (JP) ..... 2015-032616

(51) Int. Cl.
*G03G 15/20* (2006.01)
*G03G 15/00* (2006.01)

(52) U.S. Cl.
CPC ..... *G03G 15/2028* (2013.01); *G03G 15/6573* (2013.01)

(58) Field of Classification Search
CPC ..... G03G 15/2028; G03G 15/2085; G03G 15/6555; G03G 15/6573
USPC ..... 399/323, 406
See application file for complete search history.

(56) References Cited

U.S. PATENT DOCUMENTS

| | | | | |
|---|---|---|---|---|
| 7,110,711 | B2 * | 9/2006 | Tomatsu | G03G 15/6576 399/406 X |
| 2008/0145124 | A1 * | 6/2008 | Ruiz | G03G 15/6573 399/406 |
| 2010/0135705 | A1 * | 6/2010 | Lin | G03G 15/6573 399/322 |
| 2011/0227273 | A1 * | 9/2011 | Osaki | G03G 15/2028 271/10.09 |
| 2011/0299895 | A1 * | 12/2011 | Tsukioka | G03G 15/6573 399/323 X |
| 2012/0251203 | A1 * | 10/2012 | Arakawa | G03G 15/2028 399/323 |
| 2014/0219697 | A1 * | 8/2014 | Murooka | G03G 15/6576 399/406 |
| 2014/0301751 | A1 | 10/2014 | Takagi et al. | |

* cited by examiner

*Primary Examiner* — Sophia S Chen
(74) *Attorney, Agent, or Firm* — Wenderoth, Lind & Ponack, L.L.P.

(57) ABSTRACT

The fixing device includes an abutting member and an urging member. The abutting member is provided on a sheet conveyance path between a fixing roller pair and a conveying roller pair. The abutting member abuts a surface of a sheet having passed or passing through a separation plate, and the surface faces a heating roller side. The urging member urges the abutting member such that the aforementioned sheet is pressed by the abutting member to a side separated from the separation plate.

8 Claims, 6 Drawing Sheets

FIXING DEVICE AND IMAGE FORMING APPARATUS INCLUDING THE SAME

CROSS-REFERENCE TO RELATED APPLICATION

This application is based upon and claims the benefit of priority from Japanese Patent Application No. 2015-032616 filed on Feb. 23, 2015, the entire contents of which are incorporated herein by reference.

BACKGROUND

The present technology of the present disclosure relates to a fixing device and an image forming apparatus including the same.

Conventionally, there has been known a fixing device that is used in an electrophotographic image forming apparatus and fixes a toner image, which has been transferred to a sheet, to the sheet. This fixing device has a fixing roller pair. The fixing roller pair includes a heating roller and a pressure roller. At a downstream side of a fixing nip formed between the heating roller and the pressure roller, a separation plate is provided to separate a sheet from a peripheral surface of a fixing roller. The separation plate is arranged at a predetermined inclination angle such that its front end is positioned in the vicinity of the peripheral surface of the fixing roller. At a further downstream side of the separation plate, a conveying roller pair is provided to convey a sheet, which is discharged from the fixing roller pair, to the downstream side. Relative positions between the aforementioned fixing nip and a conveyance nip are various according to shapes and the like of a sheet conveyance path. For example, there has been known a fixing device in which the conveyance nip of the conveying roller pair is positioned at a heating roller side from a common tangent (a common tangent of the heating roller and the pressure roller) in the fixing nip of the fixing roller pair when viewed from an axial direction of the fixing roller pair.

SUMMARY

A fixing device according to one aspect of the present disclosure includes a fixing roller pair, a separation plate, and a conveying roller pair. The fixing roller pair includes a heating roller and a pressure roller. A fixing nip is formed between the two rollers. The separation plate is provided at a downstream side of a sheet conveyance direction from the fixing nip and separates a sheet, which is discharged from the aforementioned fixing roller pair, from the aforementioned heating roller. The conveying roller pair is provided at the downstream side of the sheet conveyance direction from the separation plate. The conveying roller pair includes a pair of conveying rollers. A conveyance nip is formed between the two rollers. The aforementioned conveyance nip is positioned at the aforementioned heating roller side from a common tangent of the aforementioned heating roller and the aforementioned pressure roller in the aforementioned fixing nip when viewed from an axial direction of the aforementioned fixing roller pair.

Furthermore, the aforementioned fixing device further includes an abutting member and an urging member. The abutting member is provided on a sheet conveyance path between the aforementioned fixing roller pair and the aforementioned conveying roller pair. The abutting member abuts a surface of a sheet having passed or passing through the aforementioned separation plate, and the surface faces the aforementioned heating roller side. The urging member urges the abutting member such that the aforementioned sheet is pressed by the aforementioned abutting member to a side separated from the aforementioned separation plate.

DETAILED DESCRIPTION

Hereinafter, an example of an embodiment of the present technology will be described in detail on the basis of the drawings. It is noted that the present technology is not limited to the following embodiments.

Embodiment

Figure 1:
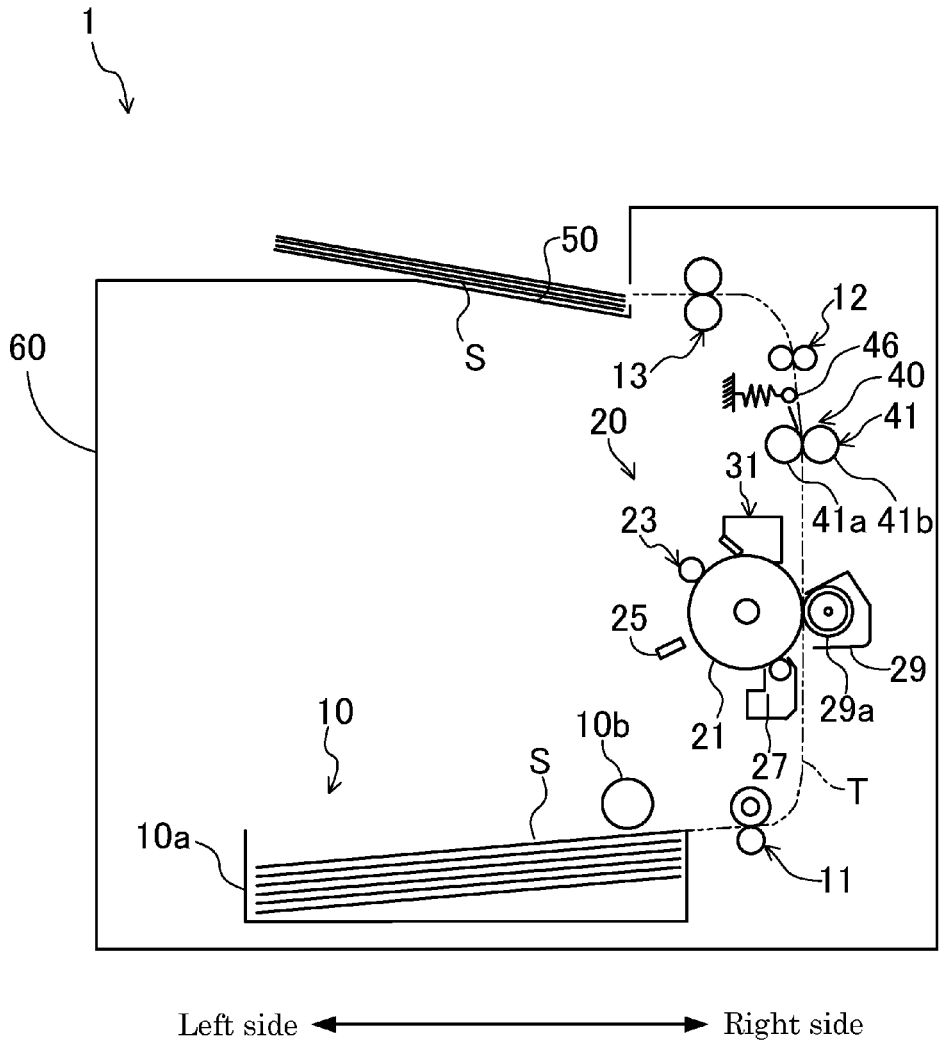
FIG. 1 is a schematic diagram illustrating an image forming apparatus including a fixing device in an embodiment.

FIG. 1 illustrates an image forming apparatus 1 in the present embodiment. The image forming apparatus 1 includes a monochrome laser printer in the present embodiment. In the following description, a "left side" and a "right side" indicate a "left side" and a "right side" when the image forming apparatus 1 is viewed from a front side (a front side in a direction vertical to the paper surface of FIG. 1).

The image forming apparatus 1 has a paper feeding unit 10, an image forming unit 20, a fixing unit 40, a paper discharge unit 50, and a casing 60. On a sheet conveyance path T from the paper feeding unit 10 to the paper discharge unit 50, a plurality of conveying roller pairs 11 to 13 are arranged to convey a sheet S while interposing it therebetween. The sheet S is not limited to a paper sheet S and for example, may be an OHP sheet and the like.

The aforementioned paper feeding unit 10 is arranged at a lower portion of the casing 60. The paper feeding unit 10 has a paper feeding cassette 10*a* in which the sheet S having a sheet shape is accommodated, and a pick-up roller 10*b* for taking out the sheet S in the paper feeding cassette 10*a* and sending the sheet S to an exterior of the cassette. The sheet S sent to the exterior of the cassette from the paper feeding cassette 10*a* is supplied to the image forming unit 20 via the conveying roller pair 11.

The image forming unit 20 has a photosensitive drum 21, a charging device 23, an exposure device 25, a developing device 27, and a transfer device 29. In the image forming unit 20, the peripheral surface of the photosensitive drum 21 is charged by the charging device 23, and then laser light based on document image data (for example, image data of a document image received from an external terminal) is irradiated to the surface of the photosensitive drum 21 by the exposure device 25, so that an electrostatic latent image is formed. The electrostatic latent image formed (carried) on the surface of the photosensitive drum 21 is developed by charged toner in the developing device 27 and becomes a toner image. The toner image is transferred to the sheet S supplied from the paper feeding unit 10 by the transfer device 29. The sheet S after the transfer is supplied to the fixing unit 40 by a transfer roller 29*a* of the transfer device 29 and the photosensitive drum 21. A reference numeral 31 indicates a cleaning device for removing unfixed toner attached to the surface of the photosensitive drum 21.

The fixing unit 40 has a fixing roller pair 41. The fixing roller pair 41 includes a heating roller 41*a* and a pressure roller 41*b*. A halogen lamp (not illustrated) serving as a heating means is arranged inside the heating roller 41*a*. The peripheral surface of the heating roller 41*a* is heated by heat generated from the halogen lamp. The pressure roller 41*b* is brought into press-contact with the heating roller 41*a* by an urging spring (not illustrated), so that a fixing nip N1 (see FIG. 2) is formed between the heating roller 41*a* and the pressure roller 41*b*. The heating means is not limited to the halogen lamp and for example, may be an IH heater and the like.

The aforementioned fixing unit 40 presses and heats the sheet S supplied from the aforementioned image forming unit 20 between the heating roller 41*a* and the pressure roller 41*b*, thereby fixing the toner image to the sheet S. The sheet S with the fixed toner image is conveyed to an upper end portion of the casing 60 by a conveying roller pair 12 arranged at a downstream side of a sheet conveyance direction (hereinafter, simply referred to as a downstream side) from the fixing roller pair 41, and then is discharged to the paper discharge unit 50 by a conveying roller pair 13.

Figure 2:
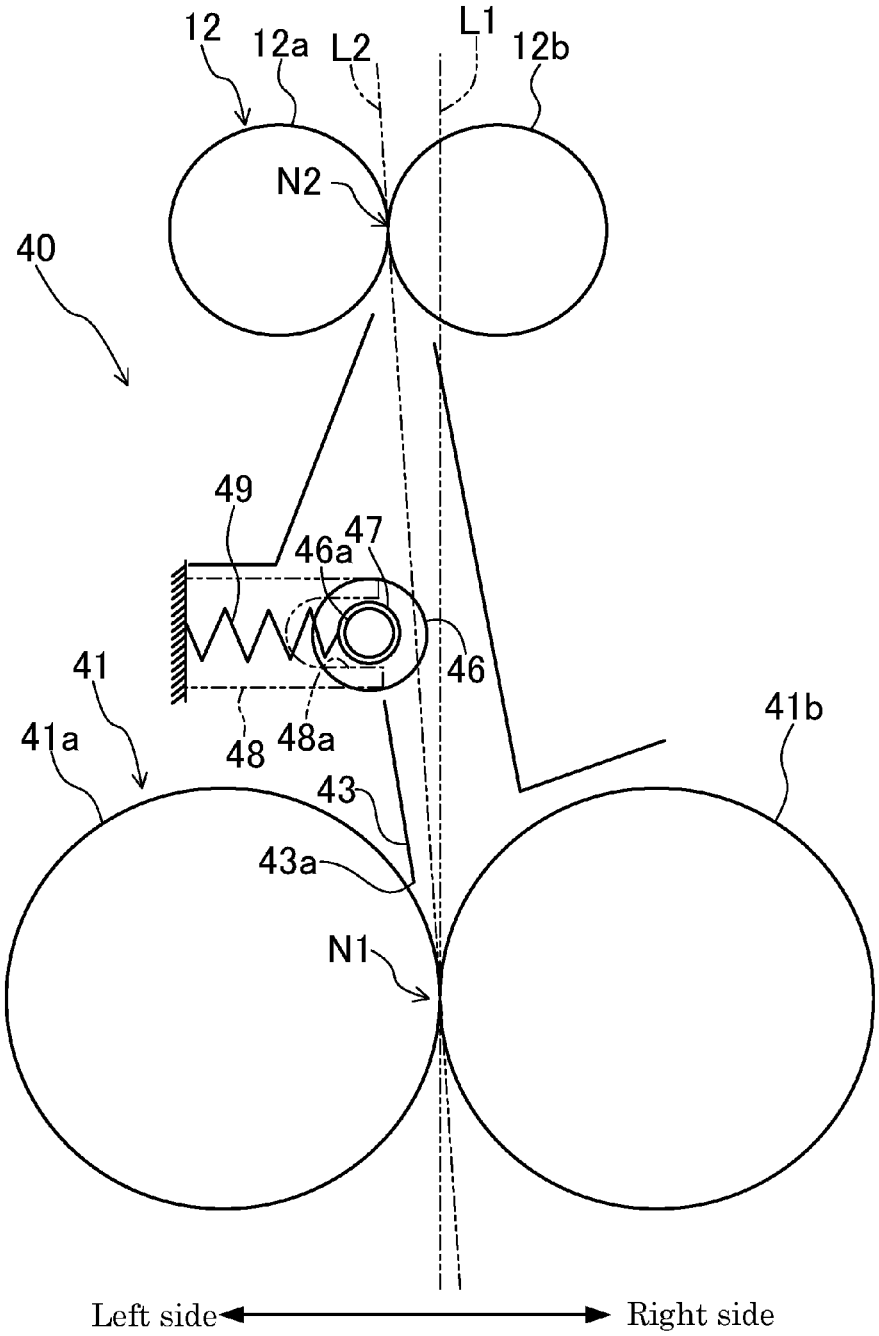
FIG. 2 is an enlarged schematic view of a fixing device, which illustrates a state before a sheet enters into a fixing device.

As illustrated in FIG. 2, the conveying roller pair 12 includes a driving roller 12*a* and a driven roller 12*b* that rotates according to the driving roller 12*a*. The driving roller 12*a* is driven by a motor (not illustrated). The driven roller 12*b* is brought into press-contact with the driving roller 12*a*, thereby forming a conveyance nip N2 between the driving roller 12*a* and the driven roller 12*b*. The conveyance nip N2 is positioned at the heating roller 41*a* side (the left side) from a common tangent L1 of the heating roller 41*a* and the pressure roller 41*b* at a fixing nip N1 when viewed from the axial direction of the fixing roller pair 41.

In the vicinity of a downstream side of the fixing nip N1, a separation plate 43 is provided. The separation plate 43 plays role of separating the sheet S, which is discharged from the fixing roller pair 41, from the heating roller 41*a*. The separation plate 43 is inclined at a predetermined angle (for example, 15° to 20°) rightward (the pressure roller 41*b* side) from an upper side to a lower side. A front end 43*a* of the separation plate 43 is positioned in the vicinity of the peripheral surface of the heating roller 41*a*. In the case in which a straight line passing through the fixing nip N1 of the fixing roller pair 41 and the conveyance nip N2 of the conveying roller pair 12 is employed as a nip line L2 when viewed from the axial direction of the fixing roller pair 41, the separation plate 43 is positioned at the heating roller 41*a* side from the nip line L2.

At a downstream side of the separation plate 43, a pressing roller (corresponding to an abutting member) 46 is arranged. The pressing roller 46 abuts a printed surface (a surface of the heating roller 41*a* side) of the sheet S having passed through the separation plate 43, thereby pressing the sheet S to a side at which the sheet S is separated from the separation plate 43.

The pressing roller 46 is a cylindrical roller extending in the axial direction of the fixing roller pair 41. The pressing roller 46 is formed by coating an outer peripheral surface of a roller axis 46*a* with an elastic member such as rubber. Both end portions of the roller axis 46*a* in the axial direction are respectively supported to a support plate 48 via a bearing 47. The support plate 48 is made of a plate-like member extending in the right and left direction and vertical to the roller axis 46*a*. A left end portion of the support plate 48 has been fixed to the casing 60. The support plate 48 is formed at a right end portion thereof with a U-shaped guide groove 48*a* opened rightward. The guide groove 48*a* extends in a direction (the right and left direction in the present embodiment) crossing the sheet conveyance path between the fixing roller pair 41 and the conveying roller pair 12. The bearing 47 is formed in a cylindrical shape and has been fitted into the guide groove 48*a* so as to be slidable in the right and left direction. The bearing 47 has been urged from the left side toward the right side by a compression coil spring (an example of an urging member) 49. A right end portion of the compression coil spring 49 has been fixed to the bearing 47 and a left end portion has been fixed to the casing 60. In the state in which the compression coil spring 49 is in a natural length state, the right end portion of the pressing roller 46 protrudes rightward from the nip line L2. The entire pressing roller 46 may also be positioned at the right side of the nip line L2.

Figure 3:
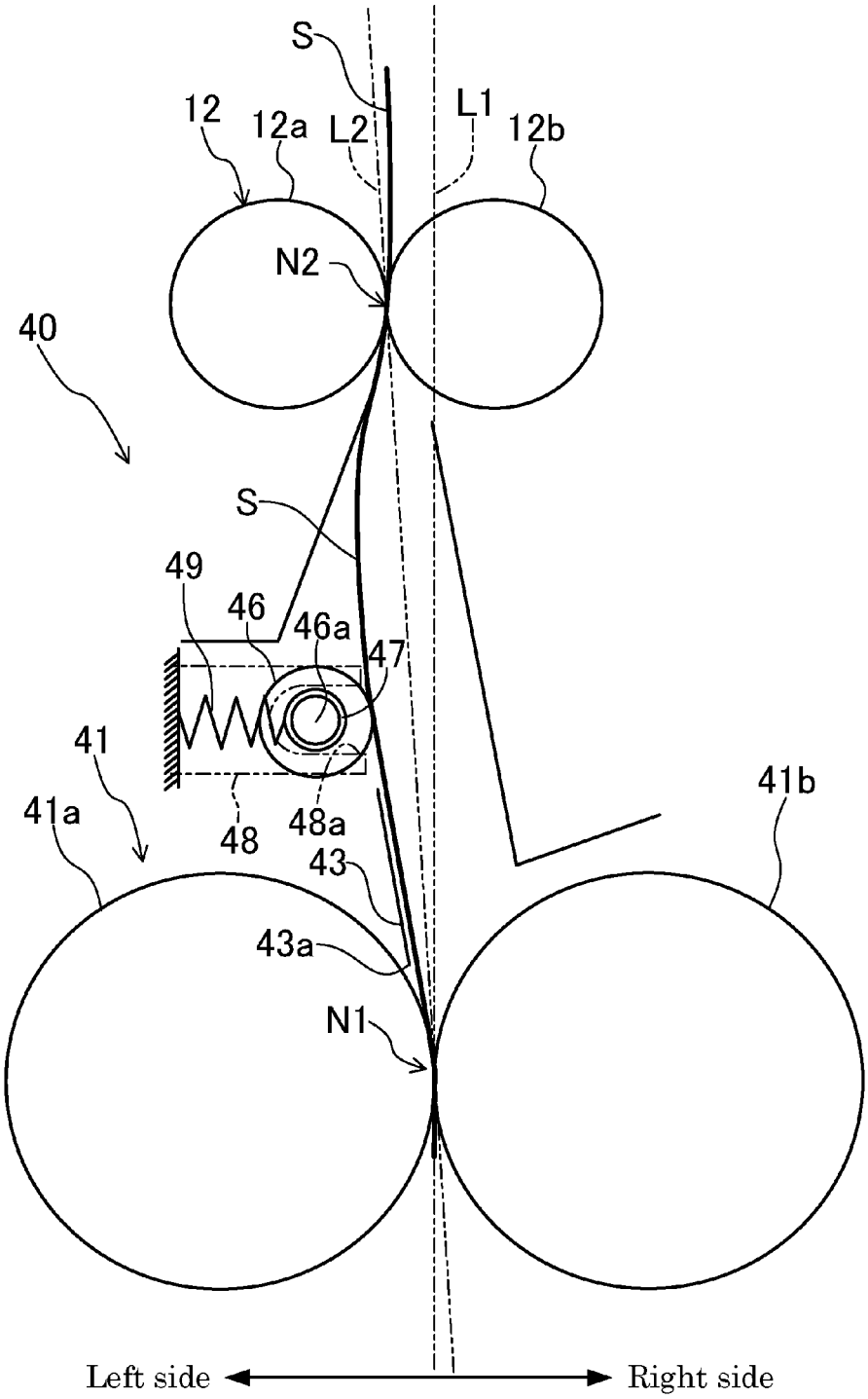
FIG. 3 is a view corresponding to FIG. 2, which illustrates a mode in which a sheet is conveyed in a state in which it has extended across a fixing roller pair and a conveying roller pair.
Figure 4:
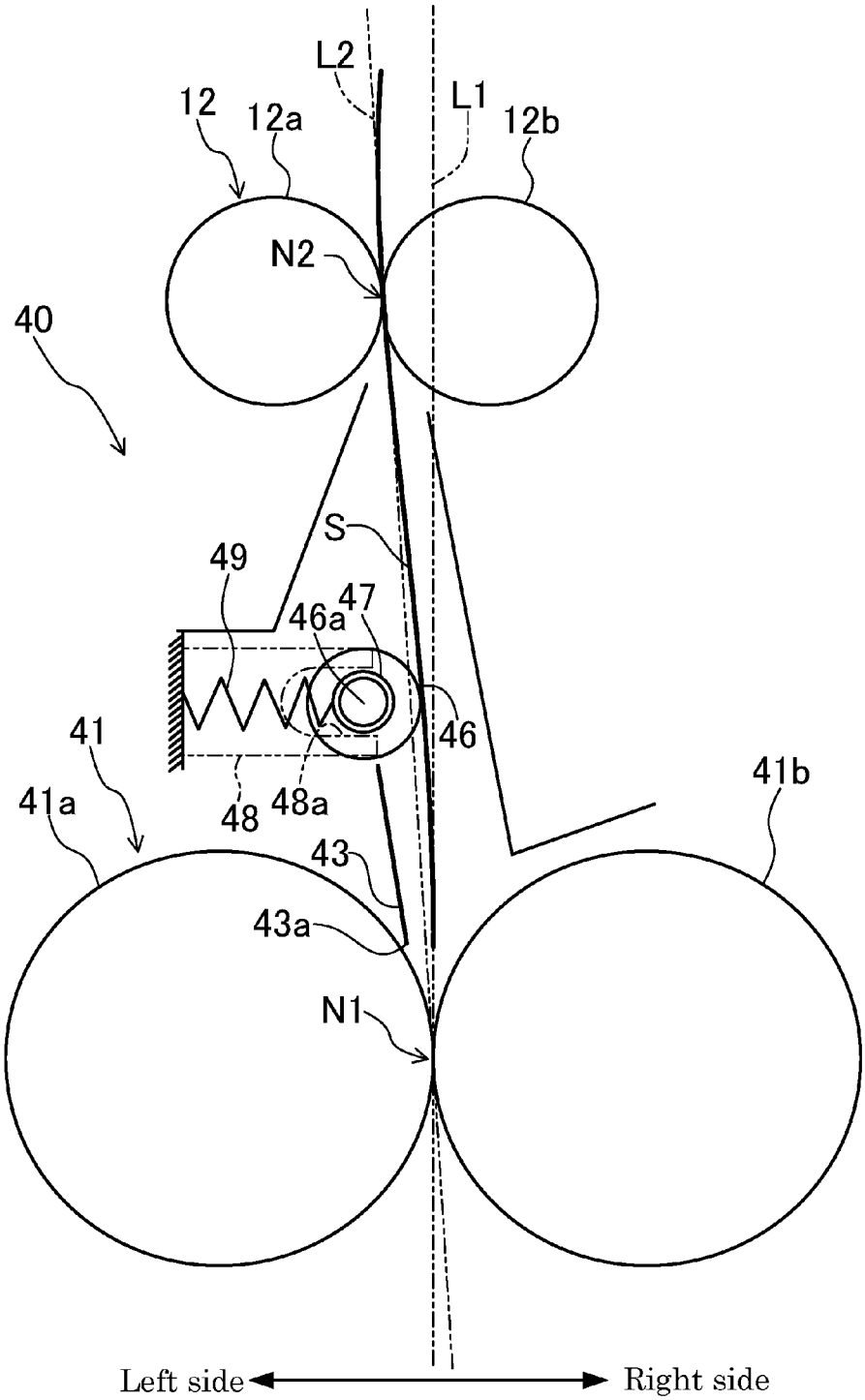
FIG. 4 is a view corresponding to FIG. 2, which illustrates a state immediately after a rear end of a sheet has escaped from a fixing nip of a fixing roller pair.

In the aforementioned image forming apparatus 1, the sheet S discharged from the fixing roller pair 41 is separated from the heating roller 41*a* by the separation plate 43 and is conveyed to the downstream side. When a front end of the sheet S in the conveyance direction (hereinafter, simply referred to as a front end of the sheet S) reaches the pressing roller 46, the peripheral surface of the pressing roller 46 is pressed leftward by the sheet S, so that the pressing roller 46 moves leftward against the urging force of the compression coil spring 49. Then, when the front end of the sheet S reaches the conveying roller pair 12 and the sheet S enters a state (a state of FIG. 3) in which it has extended across the conveying roller pair 12 and the fixing roller pair 41, tension of the sheet S becomes maximum, so that the pressing roller 46 sinks until the pressing roller 46 is approximately level with the guide surface of the separation plate 43. Thereafter, when a rear end of the sheet S in the conveyance direction (hereinafter, simply referred to as a rear end of the sheet S) passes through the fixing nip N1 of the fixing roller pair 41 and enters a state (a state of FIG. 4) in which the sheet S is conveyed only by the conveying roller pair 12, a rear end portion of the sheet S becomes free, so that the tension of the sheet S is reduced at once. At this time, in a conventional image forming apparatus 1 having no pressing roller 46, the rear end portion of the sheet S is drawn to the separation plate 43 side by its own weight and makes contact with the front end 43*a* of the separation plate 43. However, in the image forming apparatus 1 of the present embodiment, the rear end portion of the sheet S becomes free and simultaneously the spring length of the compression coil spring 49 returns to the natural length. Accordingly, the pressing roller 46 moves rightward to press and move the sheet S rightward (that is, a side separated from the separation plate 43). In this way, it is possible to prevent the rear end portion of the sheet S from abutting the front end 43*a* of the separation plate 43, thereby preventing toner from being attached to the front end 43*a* of the separation plate 43. Thus, it is possible to reliably prevent the printed surface of the sheet S from being contaminated by toner attached to the front end 43*a* of the separation plate 43.

Moreover, in the present embodiment, the separation plate 43 is arranged at the heating roller 41*a* side from the nip line L2, and the right end portion of the aforementioned pressing roller 46 protrudes to the pressure roller 41*b* side from the aforementioned nip line L2 when the compression coil spring 49 is in the natural length state. Consequently, when the rear end portion of the sheet S has become free by passing through the fixing nip N1, the spring length of the compression coil spring 49 returns to the natural length, so that it is possible to allow the rear end of the sheet S to be released to the pressure roller 41*b* side (a side opposite to the side at which the separation plate 43 is positioned) from the nip line L2. Thus, it is possible to more reliably prevent the rear end portion of the sheet S from making contact with the front end 43*a* of the separation plate 43.

Furthermore, in the present embodiment, as an abutting member abutting the printed surface of the sheet S discharged from the fixing roller pair 41, the pressing roller 46 having a cylindrical shape is employed, so that it is possible to prevent a pressed mark due to the abutting member from remaining on the printed surface of the sheet S.

Furthermore, in the present embodiment, the pressing roller 46 is urged by the compression coil spring 49 via the bearing 47. Consequently, it is possible to apply the urging force of the compression coil spring 49 to the pressing roller 46 without allowing the pressing roller 46 serving as a rotating body and the compression coil spring 49 to directly make contact with each other. Thus, it is possible to avoid wear of parts due to a contact between the pressing roller 46 and the compression coil spring 49.

Other Embodiments

Figure 5:
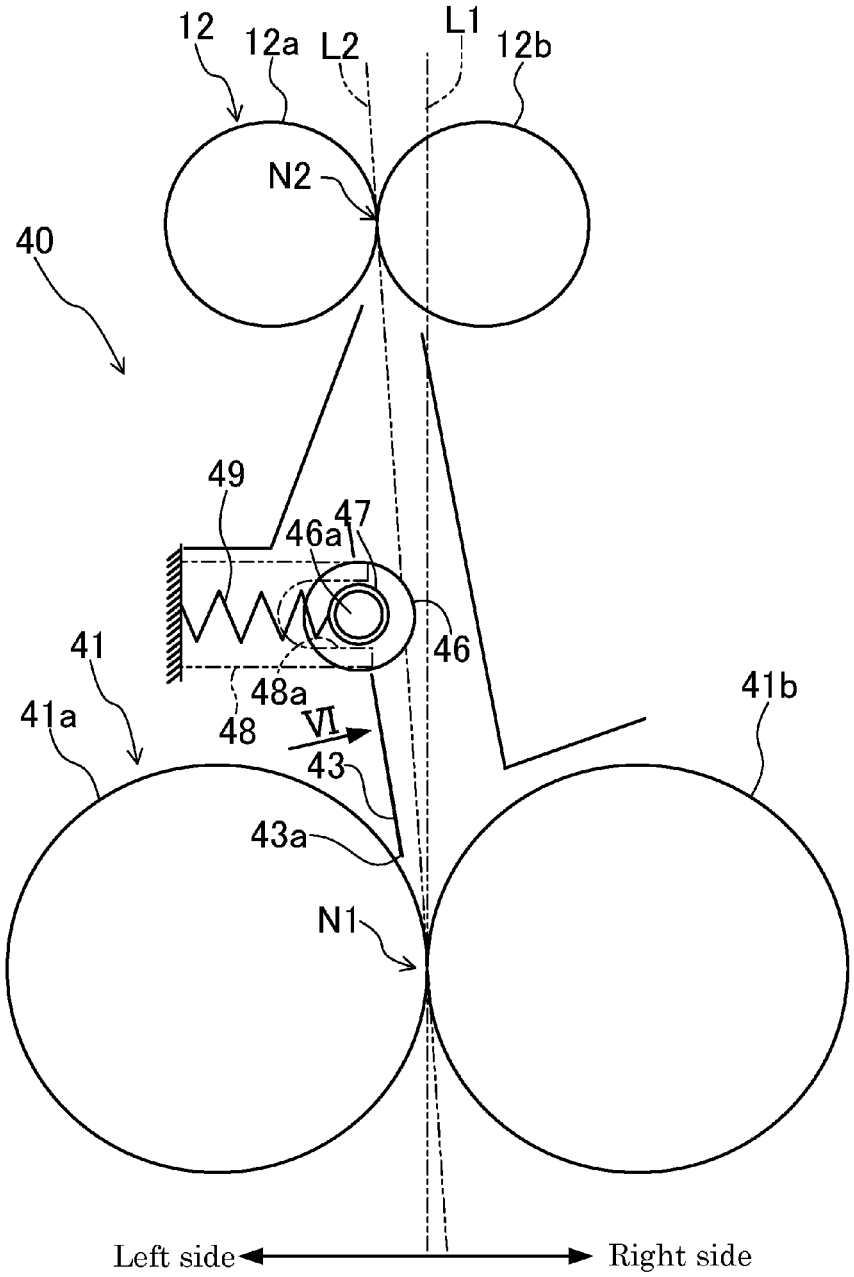
FIG. 5 is a view corresponding to FIG. 2, which illustrates another embodiment.
Figure 6:
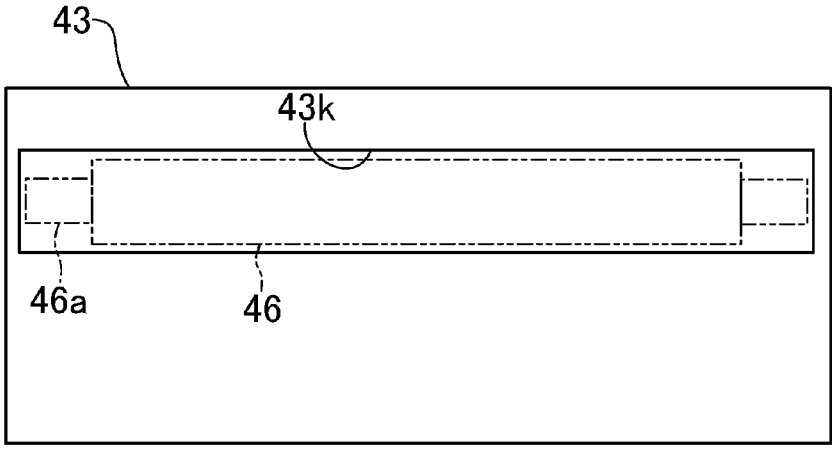
FIG. 6 is a view viewed in the arrow direction of VI in FIG. 5.

In the aforementioned embodiment, the example, in which the pressing roller 46 is arranged at a downstream side from the separation plate 43, has been described; however, the present technology is not limited thereto and the pressing roller 46 may also be provided at an intermediate part of the separation plate 43 in the sheet conveyance direction as illustrated in FIG. 5. In this case, for example, as illustrated in FIG. 6, it is sufficient if an opening 43*k* is formed in the intermediate part of the separation plate 43 in the sheet conveyance direction and the pressing roller 46 is arranged in the opening 43*k*. In this way, the pressing roller 46 abuts the printed surface of the sheet S which is passing through the separation plate 43. According to this configuration, as compared with the case in which the pressing roller 46 is arranged at the downstream side of the separation plate 43, space efficiency is improved, so that it is possible to miniaturize the entire image forming apparatus 1.

In the aforementioned embodiment, the example, in which the image forming apparatus 1 is a printer, has been described; however, the present technology is not limited thereto and the image forming apparatus 1, for example, may also include a copy machine, a multifunctional peripheral (MFP) and the like.

What is claimed is:

1. A fixing device comprising:

a fixing roller pair including a heating roller and a pressure roller and having a fixing nip formed between the two rollers;

a separation plate provided at a downstream side in a sheet conveyance direction of the fixing nip and separating a sheet, which is discharged from the fixing roller pair, from the heating roller; and a conveying roller pair provided at the downstream side in the sheet conveyance direction of the separation plate, including a pair of conveying rollers, and having a conveyance nip formed between the two rollers, wherein the conveyance nip is positioned at a heating roller side from a common tangent of the heating roller and the pressure roller in the fixing nip when viewed from an axial direction of the fixing roller pair, and the fixing device further comprises:

an abutting member provided separately from the separation plate on a sheet conveyance path between the fixing roller pair and the conveying roller pair and abutting a surface of a sheet having passed or passing through the separation plate, the surface facing the heating roller side; and an urging member that urges the abutting member such that the sheet is pressed by the abutting member to a side separated from the separation plate, wherein the separation plate is arranged at the heating roller side from a nip line passing through the fixing nip and the conveyance nip when viewed from the axial direction of the fixing roller pair, at least a part of the abutting member is positioned at a pressure roller side of the nip line when the urging member is in a natural length state, and when the urging member enters a state in which the sheet has extended across the conveying roller pair and the fixing roller pair, the urging member is compressed by the tension acted on the abutting member so that the whole of the abutting member is positioned to the heating roller side of the nip line, whereas when the sheet enters a state in which the sheet is conveyed only by the conveying roller pair, the urging member returns to the natural length as the tension is reduced so that the abutting member is moved to the pressure roller side thereby moving an abutting position of the sheet and the abutting member to the pressure roller side of the nip line.

2. The fixing device of claim 1, wherein the urging member includes a compression coil spring.

3. The fixing device of claim 1, wherein the abutting member includes a cylindrical roller member extending in a direction equal to the axial direction of the fixing roller pair.

4. The fixing device of claim 3, wherein a bearing member is provided to support the roller member so as to be rotatable, and the urging member urges the roller member via the bearing member.

5. The fixing device of claim 4, further comprising a support plate having a guide groove into which the bearing member is fitted so as to be slidable.

6. The fixing device of claim 3, wherein when the urging member enters a state in which the sheet has extended across the conveying roller pair and the fixing roller pair, an outer peripheral surface of the roller member is compressed until the outer peripheral surface of the roller member is level with the guide surface of the separation plate by the tension acted on the roller member by the sheet.

7. An image forming apparatus comprising the fixing device of claim 1.

8. The fixing device of claim 1, wherein the common tangent extends in a vertical direction.

* * * * *